US011235603B2

(12) United States Patent
Kishi

(10) Patent No.: US 11,235,603 B2
(45) Date of Patent: Feb. 1, 2022

(54) INKJET RECORDING APPARATUS

(71) Applicant: Konica Minolta, Inc., Tokyo (JP)

(72) Inventor: Hidehito Kishi, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/849,434

(22) Filed: Apr. 15, 2020

(65) Prior Publication Data

US 2020/0369053 A1 Nov. 26, 2020

(30) Foreign Application Priority Data

May 23, 2019 (JP) ..... JP2019-096610

(51) Int. Cl.
*B41J 25/304* (2006.01)
*B41J 2/14* (2006.01)

(52) U.S. Cl.
CPC ..... *B41J 25/304* (2013.01); *B41J 2/1433* (2013.01)

(58) Field of Classification Search
CPC ..... B41J 25/304; B41J 2/1433
See application file for complete search history.

(56) References Cited

U.S. PATENT DOCUMENTS

2017/0368827 A1* 12/2017 Koga ..... B41J 2/1752

FOREIGN PATENT DOCUMENTS

JP 2008-179081 A 8/2008

* cited by examiner

*Primary Examiner* — Jason S Uhlenhake
(74) *Attorney, Agent, or Firm* — Lucas & Mercanti, LLP

(57) ABSTRACT

There is provided an inkjet recording apparatus including: a plurality of ink ejectors each having a nozzle array in which two or more nozzles each of which ejects ink are one-dimensionally arranged; a support member to which the plurality of ink ejectors are attached at positions different from one another in a predetermined arrangement direction in a state where the nozzle array is oriented in the arrangement direction; and a support member deformer that deforms the support member in a direction in which a deflection of the support member is reduced.

16 Claims, 10 Drawing Sheets

INKJET RECORDING APPARATUS

CROSS-REFERENCE TO RELATED APPLICATIONS

The entire disclosure of Japanese Patent Application No. 2019-096610 filed on May 23, 2019 is incorporated herein by reference in its entirety.

BACKGROUND

Technological Field

The present invention relates to an inkjet recording apparatus.

Description of the Related Art

There is conventionally an inkjet recording apparatus in which nozzles of an ink ejector such as an ink injection head eject and cause ink to impact on a recording medium at desired positions, thereby recording an image. The ink ejector has a nozzle array in which nozzles are one-dimensionally arranged, and the inkjet recording apparatus can record an image over the width of the nozzle array by causing the nozzles to eject ink onto a recording medium which moves relatively to a direction intersecting the nozzle array.

In recent years, in order to handle such requests as for recording an image on a larger recording medium and enhancing a recording speed, inkjet recording apparatuses are employing a technology of recording a wider image by arranging a plurality of ink ejectors at positions different from one another in the arrangement direction of nozzles to form a longer line head and to eject ink from the nozzles provided in the plurality of ink ejectors of the line head. The plurality of ink ejectors forming the line head are attached and fixed to a predetermined support member while being adjusted in terms of their relative positions.

When the number of ink ejectors attached to the support member is increased, the support member possibly bends due to the weight of the ink ejectors, which causes the distances between nozzle opening faces of the ink ejectors and a recording medium to vary for the individual ink ejectors and image quality to deteriorate. Against this problem, JP 2008-179081 A discloses a technology of restraining such a variation in distances between the nozzle opening faces of the plurality of ink ejectors and a recording medium by providing, in each of the plurality of ink ejectors, a mechanism for adjusting a position regarding the ink ejection direction.

SUMMARY

However, the aforementioned conventional technology is time- and labor-consuming because of positional adjustments of all the ink ejectors.

An object of the present invention is to provide an inkjet recording apparatus for which positions of a plurality of ink ejectors can be more simply adjusted.

To achieve at least one of the abovementioned objects, according to an aspect of the present invention, an inkjet recording apparatus reflecting one aspect of the present invention comprises:

a plurality of ink ejectors each having a nozzle array in which two or more nozzles each of which ejects ink are one-dimensionally arranged;

a support member to which the plurality of ink ejectors are attached at positions different from one another in a predetermined arrangement direction in a state where the nozzle array is oriented in the arrangement direction; and a support member deformer that deforms the support member in a direction in which a deflection of the support member is reduced.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein.

DETAILED DESCRIPTION OF EMBODIMENTS

Hereinafter, one or more embodiments of the present invention will be described with reference to the drawings. However, the scope of the invention is not limited to the disclosed embodiments.

Hereafter, embodiments according to an inkjet recording apparatus of the present invention are described based on the drawings.

First Embodiment

Figure 1:
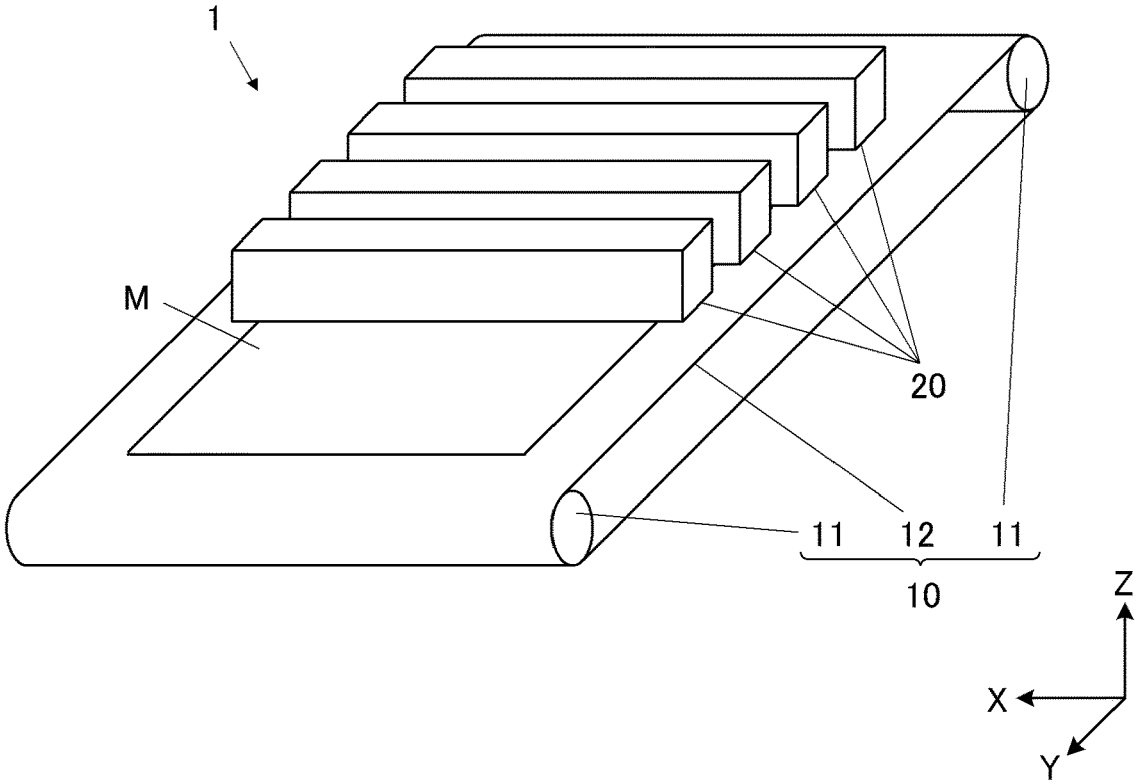
FIG. 1 is a view showing a schematic configuration of an inkjet recording apparatus.

FIG. 1 is a view showing a schematic configuration of an inkjet recording apparatus 1 which is a first embodiment of the present invention.

The inkjet recording apparatus 1 includes a conveyor 10, head units 20, and the like.

The conveyor 10 includes two conveying rollers 11, a conveying belt 12, and the like. Each conveying roller 11 rotates with its rotational axis parallel to the X-direction (width direction) in FIG. 1 as the center. The conveying belt 12 is a ring-like (endless) member which the two conveying rollers 11 support on its inner side, and circularly moves around the conveying rollers 11 in accordance with rotation of the conveying rollers 11. There is used for the conveying belt 12 a material which flexibly curves on the contact surface with each conveying roller 11 and securely supports a recording medium M, and, for example, a belt made of resin such as rubber, a steel belt, or the like can be used. The conveyor 10 conveys the recording medium M in a movement direction of the conveying belt 12 (Y-direction (conveying direction) in FIG. 1) by the conveying belt 12 circularly moving by the conveying rollers 11 rotating in accordance with motion of a not-shown conveying motor in the state where the recording medium M is placed on a conveying surface of the conveying belt 12.

The head units 20 record an image by ejecting ink onto the recording medium M which is being conveyed by the conveyor 10 in appropriate timing based on image data. In the inkjet recording apparatus 1 of the present embodiment, four head units 20 respectively corresponding to four colors of ink of yellow (Y), magenta (M), cyan (C) and black (K) are arranged so as to line up at predetermined intervals in the order of the colors of Y, M, C and K from the upstream side in the conveying direction of the recording medium M. Notably, the number of head units 20 may be three or less, or five or more.

Figure 2:
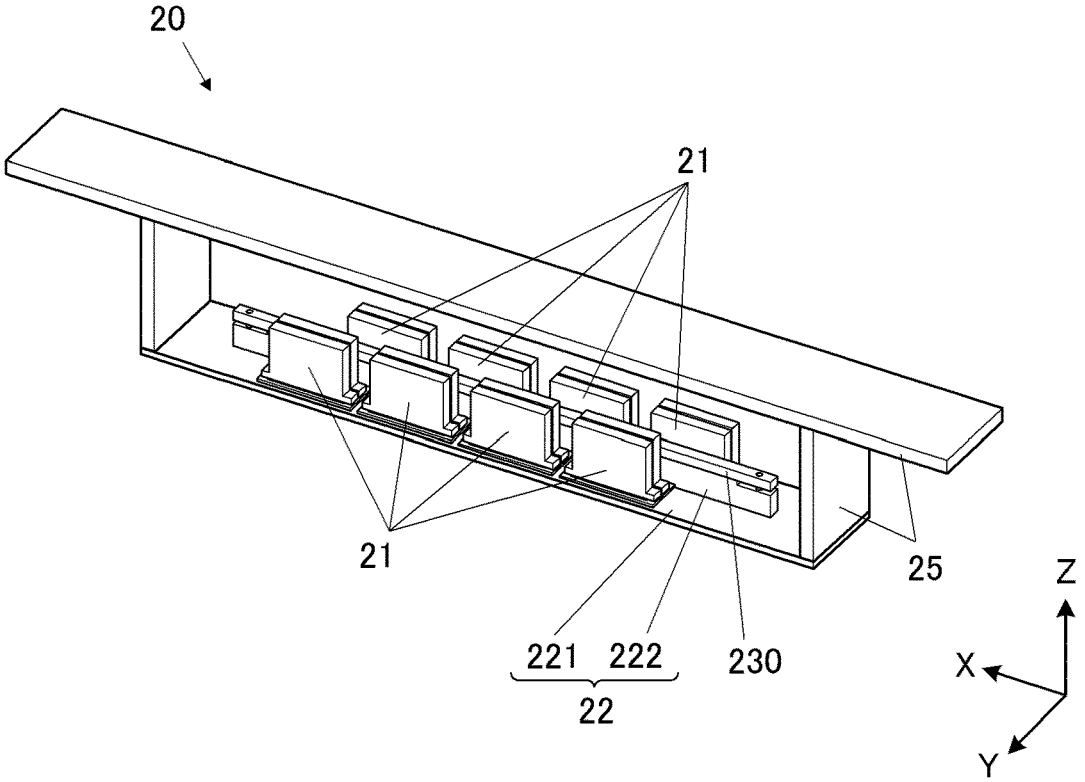
FIG. 2 is a perspective view showing an internal configuration of a head unit.

FIG. 2 is a perspective view showing an internal configuration of the head unit 20.

The head unit 20 includes eight head modules 21 (ink ejectors) each having a nozzle array in which two or more nozzles each of which ejects ink are one-dimensionally arranged, a support member 22 to which the head modules 21 are attached, a beam member 230 fixed to the support member 22, a casing 25, and the like. While the casing 25 in FIG. 2 encloses both lateral faces, of the head unit 20, which are perpendicular to the X-direction and the upper face thereof, it may further enclose both lateral faces thereof which are perpendicular to the Y-direction.

Figure 3:
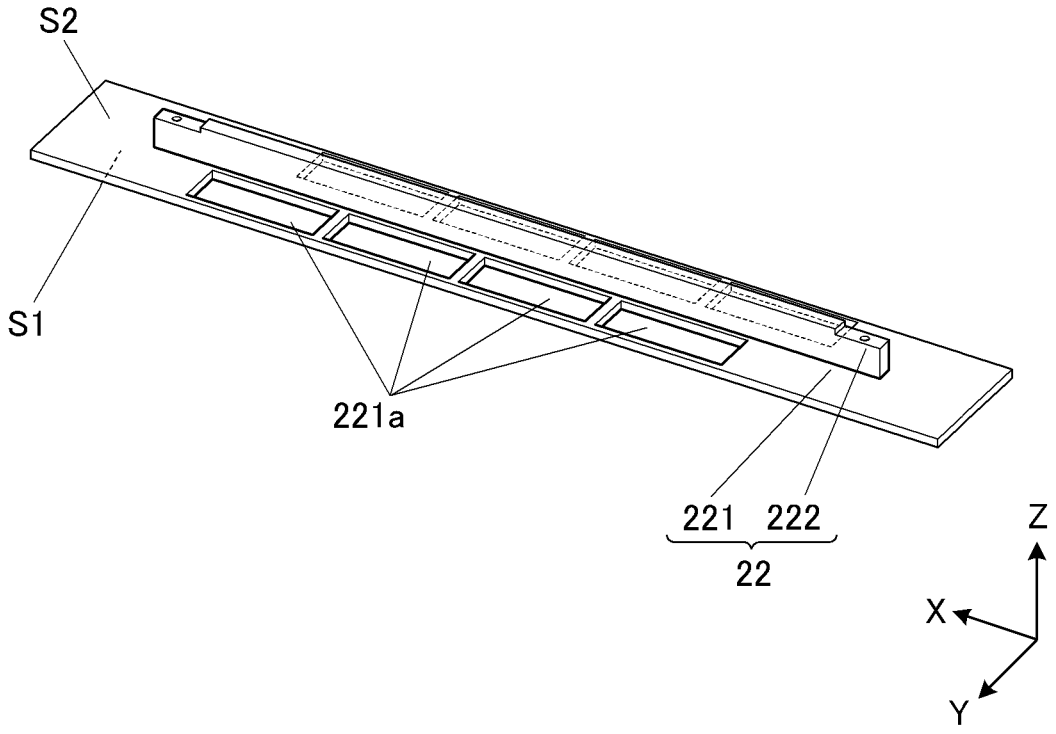
FIG. 3 is a perspective view showing a configuration of a support member.

FIG. 3 is a perspective view showing a configuration of the support member 22.

The support member 22 has a support plate 221, and a reinforcement member 222 fixed to the support plate 221.

The support plate 221 is a plate-like member perpendicular to the Z-direction, and forms a rectangular shape long in the X-direction as seen from the Z-direction. Eight through holes 221*a* are provided in the support plate 221 such that two sets of four of those form two arrays and positions of those in the X-direction are displaced from one another to form a staggered pattern. Each head module 21 is attached to the support plate 221 in the state where the head module 21 is fitted into the through hole 221*a* and a nozzle opening face on which openings of the nozzles are formed is exposed from a lower face S1 (face on the −Z-direction side) of the support plate (first face), and the support plate 221 supports these head modules 21. Moreover, when a drive circuit board for outputting drive signals to the head modules 21, various lines, ink tanks each of which stores ink supplied to the corresponding head module 21, ink channels, heaters each of which heats the ink, and the like are housed inside the casing 25, the support plate 221 also supports these components.

The reinforcement member 222 is a plate-like member, for reducing a deflection of the support plate 221, which is attached onto an upper face S2 (face on the +Z-direction side) of the support plate 221 (second face) to be oriented so as to extend in the perpendicular direction to the upper face. More in detail, the reinforcement member 222 is arranged at a position between the two arrays of the through holes 221*a* so as to go along the direction in which the through holes 221*a* line up.

For the support plate 221 and the reinforcement member 222, for example, various kinds of metal can be used. In the present embodiment, aluminum is used in view of reduction in weight.

Figure 4:
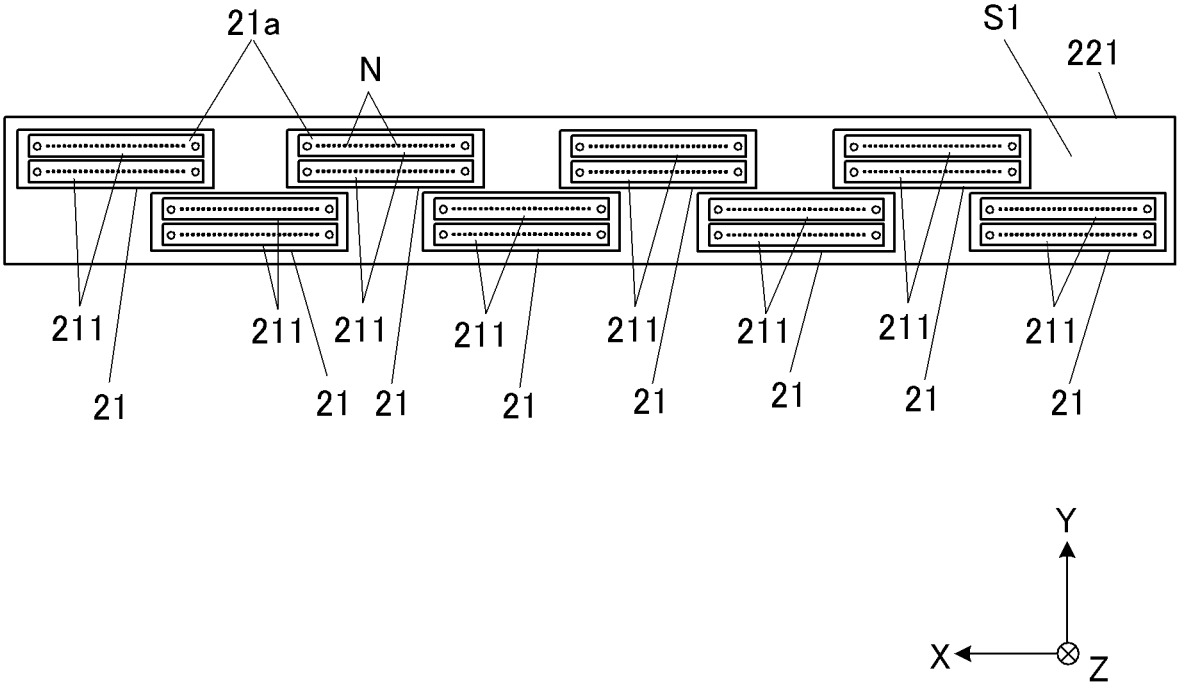
FIG. 4 is a view showing a lower face of a support plate to which head modules are attached.

FIG. 4 is a view showing the lower face S1 of the support plate 221 to which the head modules 21 are attached. There are drawn in FIG. 4 the lower face of the support plate 221 and the nozzle opening faces 21*a*, of the head modules 21, on which the openings of the nozzles N are provided.

Each head module 21 has two recording heads 211 which are arranged to be adjacent to each other in the Y-direction in a positional relation where the positions of the nozzles N are displaced from one another in the X-direction. Each recording head 211 (accordingly, each head module 21) is arranged in the state where the nozzle arrays are oriented in the X-direction (arrangement direction). Each recording head 211 defines intervals between the nozzles N so as to enable recording with resolution of 600 dots per inch (dpi) in the X-direction. Combination of these two recording heads 211 enables the head module 21 to record an image with resolution of 1200 dpi in the X-direction. Notably, while in FIG. 4, each recording head 211 has a single nozzle array, not limited to this, each recording head may have two or more nozzle arrays.

A mechanism for ejecting ink from the nozzle N is not specially limited but there can be used, for example, a mechanism including a piezoelectric element on the wall surface of a pressure chamber communicating with the nozzle N, the mechanism working by deforming the piezoelectric element (accordingly, the pressure chamber) to cause a pressure change on the ink in the pressure chamber and to eject the ink from the nozzle N.

The eight head modules 21 are attached and fitted into the through holes 221*a* of the support plate 221, and thereby, are arranged at positions different from one another in the X-direction in the state where the nozzle arrays are oriented in the X-direction. Moreover, the eight head modules 21 are attached to the support plate 221 in a staggered pattern in a positional relation where ranges where ink can be ejected from the plurality of nozzles N included in these head modules 21 are connected continuously in the X-direction, and these nozzles N are provided over a recording width, in the X-direction, for an image onto the recording medium M. Accordingly, the eight head modules 21 form a line head long in the X-direction. The head unit 20 having such a line head is used with its position fixed in image recording, sequentially ejects ink at positions different in the conveying direction at predetermined intervals (conveying direction intervals) according to conveyance of the recording medium M, and thereby, records an image in a single-pass system.

Notably, the arrangement direction of each nozzle array in the head unit 20 may be, other than the direction parallel to the X-direction, a direction intersecting the Y-direction at an angle other than a right angle. Moreover, while in the present embodiment, each head unit 20 is exemplarily described as having eight head modules 21, the number of head modules 21 is not limited to this but may be seven or less, or nine or more depending on the recording width of an image.

Figure 5A:
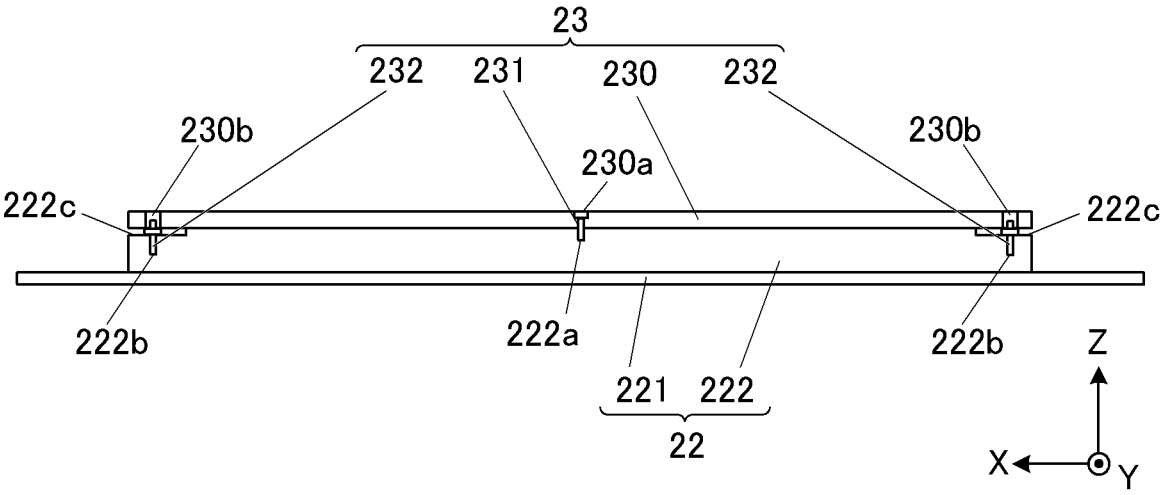
FIGS. 5A and 5B are views showing a configuration of a beam member.
Figure 5B:
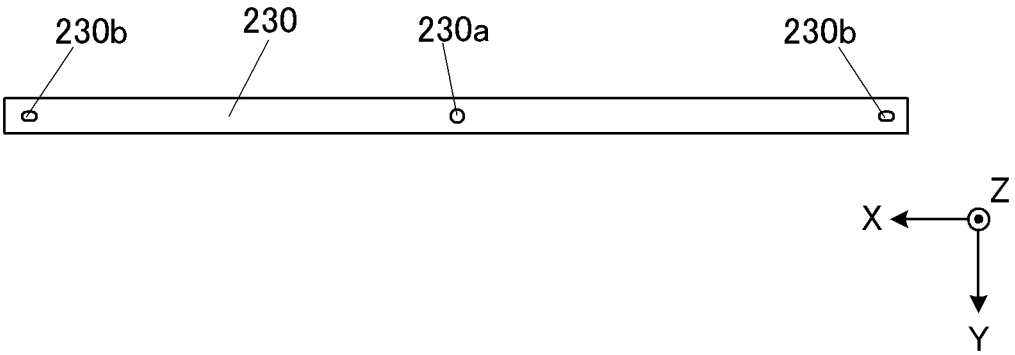

FIGS. 5A and 5B are views showing a configuration of the beam member 230. FIG. 5A is a view of the support member 22 and the beam member 230 as seen from the +Y-direction, and FIG. 5B is a view of the beam member 230 as seen from the +Z-direction.

The beam member 230 is a member in a quadrangular prism shape in which its length in the X-direction and its width in the Y-direction are substantially equal to those of the reinforcement member 222. The beam member 230 extends across a range including ranges where the nozzles N are provided in the eight head modules 21 in the X-direction (arrangement direction of the nozzle array). The beam member 230 is a member which is a support for deforming the support member 22 such that a deflection of the support member 22 is reduced as mentioned later, and it employs a material higher in rigidity than the support member 22 (aluminum) (that is, larger in Young's modulus than the same), such, for example, as iron and stainless steel.

As shown in FIG. 5A, the beam member 230 is attached and fixed to an upper part of the reinforcement member 222 with one fixing connection member 231 and two adjusting connection members 232 (adjustment members). The fixing connection member 231 connects the beam member 230 and the reinforcement member 222 at a center position of the beam member 230 in the X-direction, and the adjusting connection members 232 connect the beam member 230 and the reinforcement member 222 near both ends of the beam member 230 in the X-direction. The beam member 230, the fixing connection member 231 and the adjusting connection members 232 constitute a support member deforming part 23 (support member deformer). The support member deforming part 23 can deform the support member 22 such that a deflection of the support member 22 is reduced.

The fixing connection member 231, which is a screw which is fitted into a screw hole 222*a* provided in the reinforcement member 222, is fixed and fitted into the screw hole 222*a* through an attachment hole 230*a* provided in the beam member 230, and thereby, connects and fixes the beam member 230 and the reinforcement member 222 together.

Figure 6:
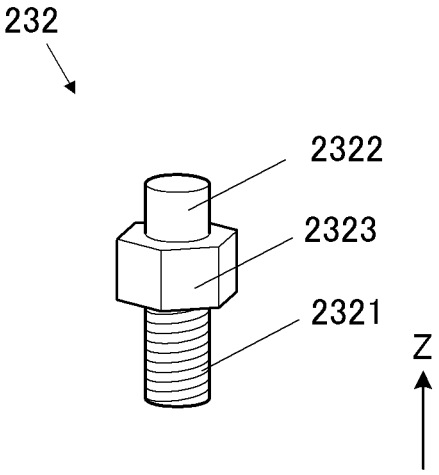
FIG. 6 is a view showing a configuration of an adjusting connection member.

FIG. 6 is a view showing a configuration of each adjusting connection member 232.

The adjusting connection member 232 forms a screw part 2321 on the reinforcement member 222 side (−Z-direction side), and a pin-like part 2322 without a screw thread on the beam member 230 side (+Z-direction side). Moreover, a hexagonal prism-shaped base part 2323 is provided between the screw part 2321 and the pin-like part 2322. The whole adjusting connection member 232 can be rotated by the base part 2323 rotated by a wrench or the like.

Notably, the reinforcement member 222 side of the adjusting connection member 232 may be the pin-like part 2322, the beam member 230 side therefore being the screw part 2321. Moreover, the reinforcement member 222 side or the beam member 230 side of the adjusting connection member 232 may have a structure of a stepped screw composed of a cylinder part and a screw part.

As shown in FIG. 5A, the adjusting connection members 232 connect the beam member 230 and the reinforcement member 222 in the state where the base parts 2323 are positioned at gaps between the beam member 230 and the reinforcement member 222. More in detail, providing notch parts 222*c* on upper faces of end parts of the reinforcement member 222 in the X-direction forms gaps between the reinforcement member 222 and the beam member 230, and the base parts 2323 are positioned at these gaps.

Moreover, screw holes 222*b* are provided in the −Z-direction from the notch parts 222*c* in the reinforcement member 222, and the screw parts 2321 of the adjusting connection members 232 are fixed and fitted into the screw holes 222*b* of the reinforcement member 222.

Moreover, attachment holes 230*b* are provided at positions, in the beam member 230, that face the notch parts 222*c*, and the pin-like parts 2322 of the adjusting connection members 232 are fitted into the attachment holes 230*b* of the beam member 230. By the pin-like parts 2322 being fitted into the attachment holes 230*b*, the reinforcement member 222 and the beam member 230 are connected in a predetermined positional relation.

The maximum diameter of each base part 2323 is herein larger than that of the each attachment hole 230*b*. Thereby, the adjusting connection members 232 can support the beam member 230 on the upper faces of the base parts 2323. Accordingly, the adjusting connection members 232 connect the reinforcement member 222 and the beam member 230 in the state where the base parts 2323 cause resistance to act on the beam member 230 in the +Z-direction and the screw parts 2321 cause resistance to act on the reinforcement member 222 in the −Z-direction. Namely, the adjusting connection members 232 fix the distance between the reinforcement member 222 and the beam member 230 in the state of exerting force on the reinforcement member 222 and the beam member 230 in directions where they separate from each other.

Moreover, as shown in FIG. 5B, while the attachment hole 230*a* provided in the beam member 230 is circular as seen from the Z-direction, each attachment hole 230*b* is a long hole extending in the X-direction. The attachment holes 230*b* of the two adjusting connection members 232 are long holes as above, and thereby, connection positions with the adjusting connection members 232 (positions where the base parts 2323 support the beam member 230) are configured to be automatically adjusted in the X-direction when the support member 22 and the beam member 230 are deformed in different deformation amounts caused by a difference in coefficient of thermal expansion between those. Therefore, the support member 22 and the beam member 230 can be restrained from being distorted under exertion of force on these from the three connection positions in the case of thermal expansion.

Notably, the attachment hole 230*a* at the center and one of the attachment holes 230*b* at both ends may be the long holes without limitation to the configuration of the attachment holes 230*b* at both ends being the long holes.

As above, the beam member 230 is provided such that its distances from the upper face S2 of the support member 22 at a plurality of positions (herein, the three positions) different in the X-direction can be fixed with the fixing connection member 231 and the adjusting connection members 232.

Moreover, by rotating each base part 2323 in the state of FIG. 5B to move the adjusting connection members 232 in the ±Z-direction relative to the reinforcement member 222, the distance between the reinforcement member 222 and the beam member 230 at the position where the adjusting connection members 232 (hereinafter also expressed as "adjustment position") are provided can be adjusted. Thereby, the support member 22 can be deformed such that a deflection of the support member 22 is reduced. This will be mentioned later more in detail.

Figure 7:
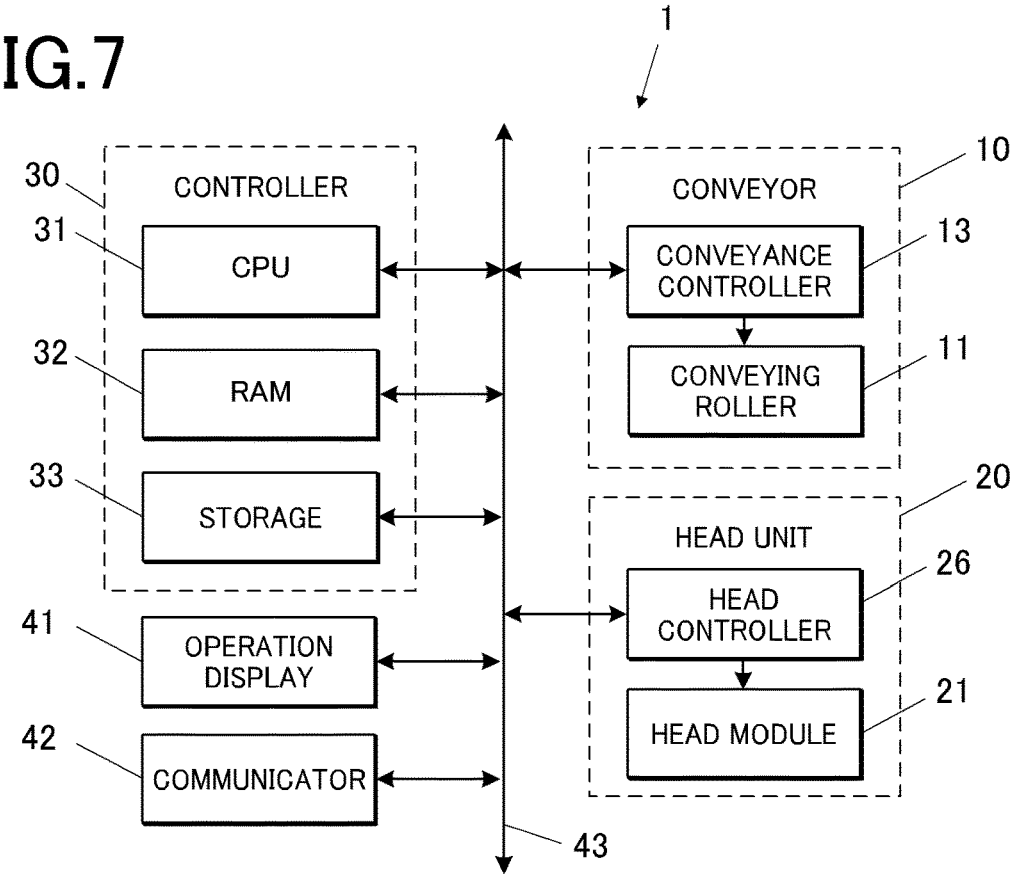
FIG. 7 is a block diagram showing a main functional configuration of the inkjet recording apparatus.

FIG. 7 is a block diagram showing a main functional configuration of the inkjet recording apparatus 1.

The inkjet recording apparatus 1 includes the conveyor 10 having a conveyance controller 13 and the conveying rollers 11, the head units 20 each having a head controller 26 and the head modules 21, a controller 30 having a CPU 31 (Central Processing Unit), a RAM 32 (Random Access Memory) and a storage 33, an operation display 41, a communicator 42, and the like, and these are connected to one another via a bus 43 so as to be able to transmit and receive signals to/from one another.

The conveyance controller 13 operates the conveying motor which rotates the conveying rollers 11 based on a control signal supplied from the controller 30 to cause the conveying rollers 11 to rotate at an appropriate speed in appropriate timing, and thus, causes the conveying belt 12 to circularly move.

The head controller 26 outputs various control signals and image data to the head modules 21 (recording heads 211) in appropriate timing based on a control signal supplied from the controller 30, and thereby, causes the nozzles N to eject ink.

The controller 30 integrally controls the whole operation of the inkjet recording apparatus 1.

The CPU 31 reads a control program stored in the storage 33, and performs various kinds of control processing regarding image forming and its configuration.

The RAM 32 provides a working memory space for the CPU 31, and stores temporary data.

The storage 33 includes a nonvolatile memory which stores the control program, setting data and the like. Moreover, the storage 33 may include a DRAM or the like which temporarily stores settings regarding image forming instructions (print jobs) externally acquired via the communicator 42, image data for images to be recorded, and the like.

The operation display 41 displays status information, menu, and the like regarding image forming, and accepts input operation from a user. The operation display 41 exemplarily includes a display screen composed of a liquid crystal panel and a driver of the liquid crystal panel, a touch panel overlappedly provided on a liquid crystal screen, and the like, and outputs an operation detection signal according to a position where the user has made touch operation and a type of the operation to the controller 30.

The communicator 42 transmits and receives data to/from external devices in conformity with predetermined communication standards. The communicator 42 includes connection terminals in conformity with communication standard used, hardware (network card) for a driver regarding communication connection, and the like.

Next, an adjustment method of a deflection of the support member 22 in the head unit 20 is described.

It is needed for distances between the nozzle opening faces 21*a* of the head module 21 in the head unit 20 and the recording medium M on the conveying belt 12 to be uniform at a predetermined value (typically, about 1 mm). The reason is as follows. If a distance between the nozzle opening face 21*a* and the recording medium M is displaced from the predetermined value, image quality of a recorded image deteriorates since an impact position of ejected ink results in being displaced from a desired position, which causes color unevenness and concentration unevenness.

Meanwhile, as mentioned above, the head unit 20 is long in the X-direction by the plurality of head modules 21 arranged at the positions different from one another in the X-direction. A larger recording medium M which is a recording target is being often used in recent years, and accordingly, the number of head modules 21 implemented in the head unit 20 increases more, which causes the length of the head unit 20 in the X-direction to be larger. As a result, some head units 20 the length of which in the X-direction exceeds 1 m have been provided on the market, and there is a tendency that the length grows to be larger and larger.

Therefore, the distance between the nozzle opening face 21*a* of a head module 21 near the center in the X-direction and the recording medium M tends to be smaller than the predetermined value since the weights of the head modules 21 and the like bend the support member 22 (in particular, the support plate 221). By contrast, it is growing more difficult to sufficiently prevent such ease of bending due to the long head unit 20 by a method of reducing such a deflection of the support member 22 by making the head modules 21 light in weight or by employing a configuration, of the support member 22, high in strength in the vertical direction.

Therefore, with the inkjet recording apparatus 1 of the present embodiment, the support member deforming part 23 composed of the beam member 230, the fixing connection member 231 and the adjusting connection members 232 can deform the support member 22 in a direction in which the deflection of the support member 22 is reduced.

Figure 8A:
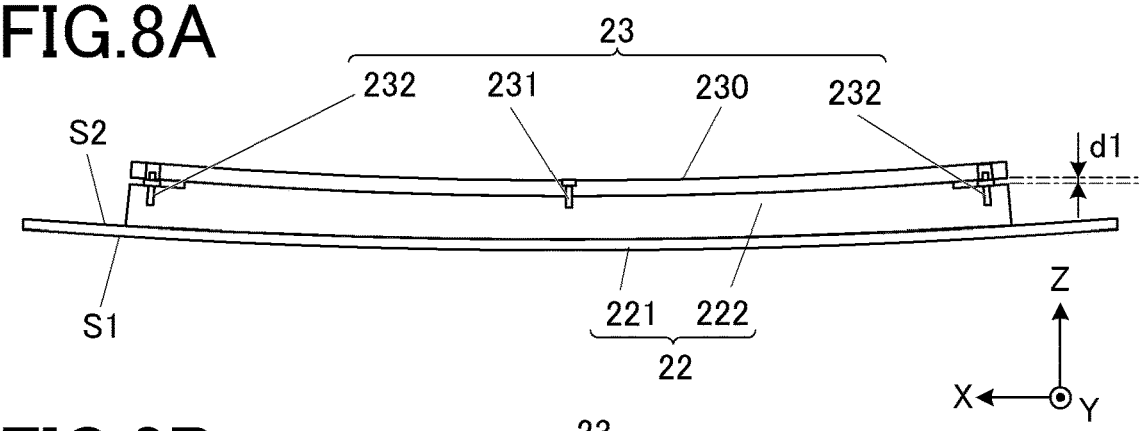
FIGS. 8A and 8B are views for explaining an adjustment method of a deflection of the support member.
Figure 8B:
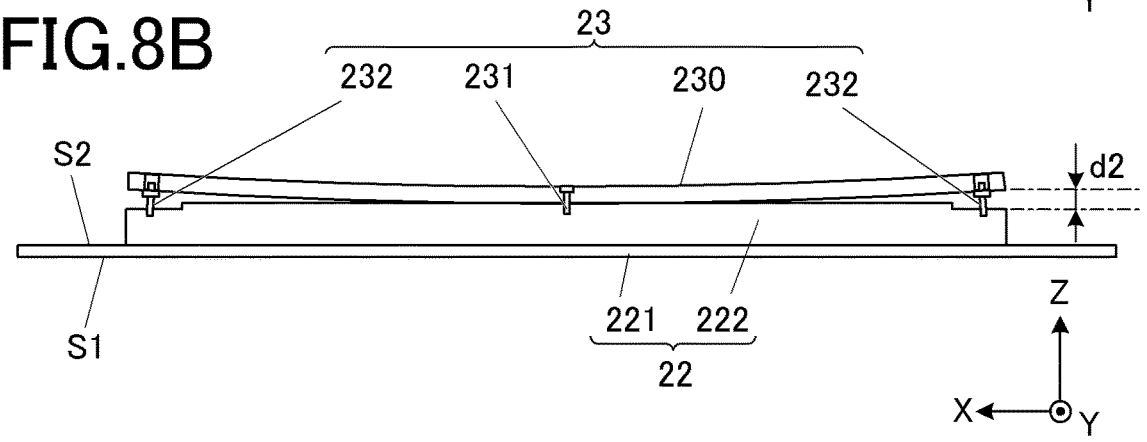

FIGS. 8A and 8B are views for explaining an adjustment method of a deflection of the support member 22. Illustration of the head modules 21 is omitted from FIGS. 8A and 8B for convenience of explanation.

FIG. 8A shows a state where the support member 22 bends due to the weight of the head modules 21. In this state, the lower face S1 and the upper face S2 of the support plate 221 curve to be convex downward and form curved faces, displaced from a flat plane. In other words, a deflection arises on the support plate 221 by which deflection the lower face S1 and the upper face S2 are displaced from the flat plane.

Moreover, in the state of FIG. 8A, the beam member 230, as well as the support member 22, bends to be convex downward. The reason is that the distance between the reinforcement member 222 of the support member 22 and the beam member 230 is fixed at the three points with the fixing connection member 231 and the two adjusting connection members 232. In the state of FIG. 8A, the distance between the reinforcement member 222 and the beam member 230 at the adjustment position in the Z-direction where the adjusting connection member 232 is provided, is a distance d1.

By rotating the two adjusting connection members 232 from the state of FIG. 8A to move the adjusting connection members 232 to the +Z-direction side relative to the reinforcement member 222, the distance between the reinforcement member 222 and the beam member 230 at the adjustment position in the Z-direction can be increased (FIG. 8B). In the state of FIG. 8B, the distance between the reinforcement member 222 and the beam member 230 at the adjustment position is a distance d2 (>d1). Meanwhile, the distance between the reinforcement member 222 and the beam member 230 at the center position in the X-direction is fixed.

By making the distance between the support member 22 and the beam member 230 at the adjustment position near the end part in the X-direction large in the state where this distance is fixed at the center position as above, the support member 22 can be deformed in the direction in which the deflection of the support member 22 is reduced (that is, the direction in which the deflection by which the lower face S1 and the upper face S2 of the support plate 221 are displaced from the flat plane is reduced) with the beam member 230 as a support. Further, by appropriately adjusting the amount of rotation of the adjusting connection member 232, that is, the distance between the reinforcement member 222 and the beam member 230 at the adjustment position, as shown in FIG. 8B, the deflection of the support member 22 can be relieved to make the lower face S1 and the upper face S2 of the support plate 221 be flat faces.

As above, the support member deforming part 23 deforms the support member 22 in the direction in which the deflection of the support member 22 is reduced.

Moreover, providing the adjusting connection members 232 on the upper face S2 side of the support member 22 enables the deflection to be easily adjusted even in the state where the support member 22 faces the conveying belt 12.

Notably, since the deflection of the support plate 221 is typically about tens of micrometers to hundreds of micrometers, the beam member 230 only has to have strength for supporting and deforming the support plate 221 by tens of micrometers to hundreds of micrometers. While with FIGS. 8A and 8B, the beam member 230 is drawn not to be deformed for convenience of explanation, the beam member 230 may be deformed by about several millimeters in the reverse direction to that for the support plate 221 in response to the deformation of the support plate 221. In this case, in order to prevent plastic deformation of the beam member 230, it is desirable for the adjusting connection members 232 to be provided capable of adjusting the distance between the beam member 230 and the support member 22 within a range where the deformation of the beam member 230 is elastic deformation. The larger the ratio of the deformation amount of the beam member 230 relative to the deformation amount of the support member 22 is, the finer the deformation amount of the support member 22 can be adjusted.

Moreover, providing adjusting connection members 232 at three or more places enables the deflection of the support member 22 to be more accurately adjusted.

After the deflection of the support member 22 is relieved as above, the height of the head unit 20 in the Z-direction is to be adjusted with a not-shown height adjustment mechanism, and thereby, the distances between the nozzle opening faces 21*a* of the head modules 21 and the conveying surface of the conveying belt 12 can be made uniform at a predetermined value.

A method for confirming that the deflection of the support member 22 is relieved and the lower face S1 of the support plate 221 is a flat face and that the distances between the nozzle opening faces 21*a* and the conveying surface of the conveying belt 12 are uniform is not specially limited but there can be used a method of using any distance meter such as ones in a contact system and in an optical system, the method working by measuring the distance between the nozzle opening face 21*a* and the conveying surface or the distance between the lower face S1 of the support plate 221 and the conveying surface at a plurality of positions in the X-direction.

(Modification 1)

Next, Modification 1 of the aforementioned embodiment is described. The present modification is different from the aforementioned embodiment in an adjustment method of a deflection of the support member 22. Its differences from the aforementioned embodiment are hereafter described.

Figure 9A:
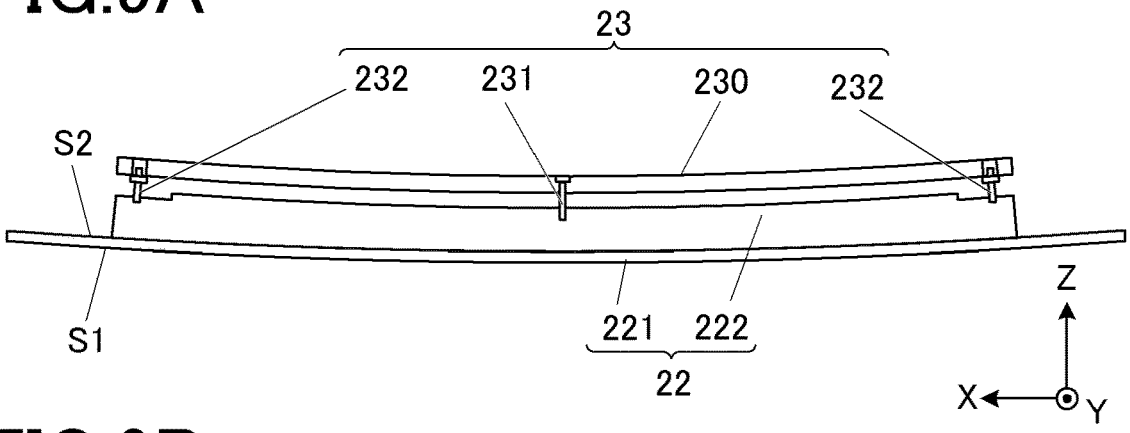
FIGS. 9A and 9B are views for explaining an adjustment method of a deflection of the support member according to Modification 1.
Figure 9B:
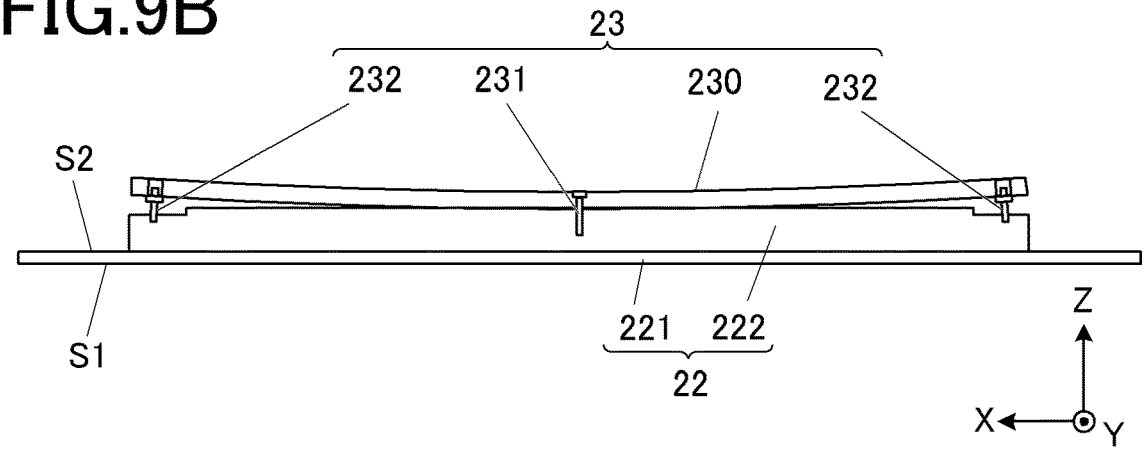

FIGS. 9A and 9B are views for explaining an adjustment method of a deflection of the support member 22 according to Modification 1.

In the present modification, a gap is beforehand provided between the reinforcement member 222 of the support member 22 and the beam member 230. Then, when the support member 22 and the beam member 230 bend to be convex downward as shown in FIG. 9A, the fixing connection member 231 is fastened to reduce the distance between the reinforcement member 222 and the beam member 230 at the center position in the X-direction (FIG. 9B). Thereby, the support member 22 can be deformed in the direction in which the deflection of the support member 22 is reduced with the beam member 230 as a support. Moreover, by adjusting the sole fixing connection member 231, the deflection of the support member 22 can be simply reduced.

In the present modification, the position of the fixing connection member 231 corresponds to the adjustment position, and the fixing connection member 231 constitutes the adjustment member.

(Modification 2)

Next, Modification 2 of the aforementioned embodiment is described. The present modification is different from the aforementioned embodiment in that a holder member 233 is provided for reinforcing the beam member 230. Its differences from the aforementioned embodiment are hereafter described.

Figure 10A:
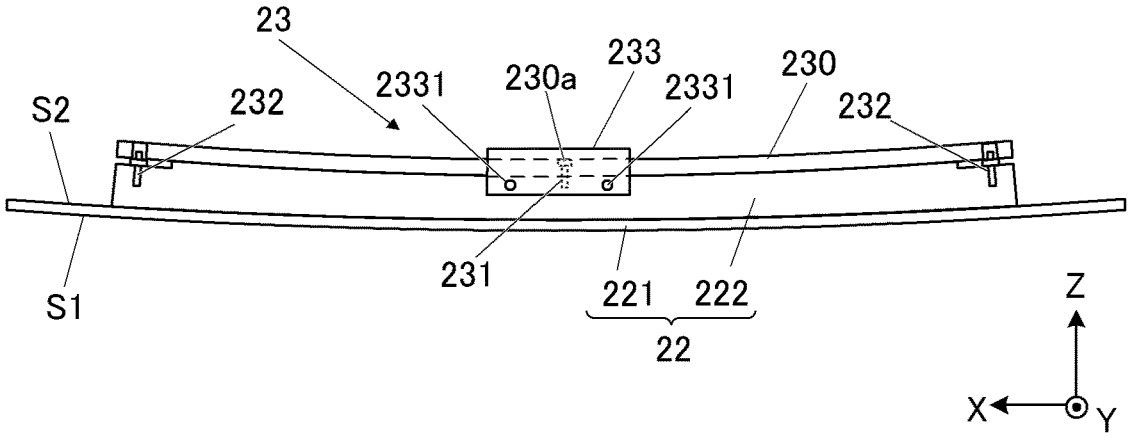
FIGS. 10A and 10B are views showing a configuration of the support member and a support member deforming part according to Modification 2.
Figure 10B:
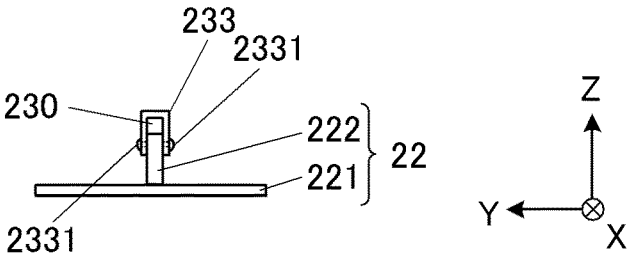

FIGS. 10A and 10B are views showing a configuration of the support member 22 and the support member deforming part 23 according to Modification 2. FIG. 10A is a view of the support member 22 and the support member deforming part 23 as seen from the +Y-direction, and FIG. 10B is a view of the support member 22 and the beam member 230 as seen from the −X-direction.

Since in the beam member 230, the attachment hole 230*a* for attaching the fixing connection member 231 is provided at its center position in the X-direction, the beam member 230 tends to be weak in strength at the center position. Therefore, when adjusting a deflection of the support member 22, there can arise a failure of the beam member 230 bending and breaking at the center position depending on the material and/or the shape of the beam member 230.

Therefore, in the present modification, as shown in FIGS. 10A and 10B, the support member deforming part 23 has the holder member 233 for reinforcing the center part of the beam member 230. The holder member 233 is an integrated member which encloses three sides of parts of the beam member 230 and the reinforcement member 222 on both lateral faces in the Y-direction and a part thereof on the upper face, and is fixed to the reinforcement member 222 with fastening members 2331. The length of the holder member 233 in the X-direction is set to be within a range where it covers a region, of the beam member 230, where the strength thereof deteriorates and where it does not disturb deformation, of the beam member 230 and the reinforcement member 222, that is needed in adjusting a deflection of the support member 22. Providing such a holder member 233 can restrain the beam member 230 from bending and breaking at its center position.

Figure 11:
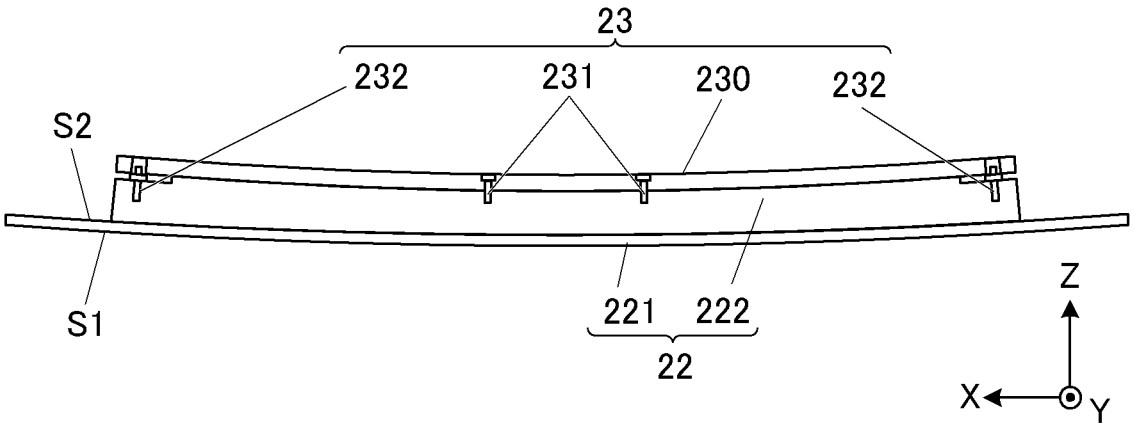
FIG. 11 is a view showing another example of the configuration of the support member and the support member deforming part according to Modification 2.

Notably, in place of the configuration in which the holder member 233 is provided, as shown in FIG. 11, fixing connection members 231 may be provided at two places sandwiching the center position in the X-direction. When there can be ignored a deflection of the support member 22 and the beam member 230 near the center position in the X-direction, provided such fixing connection members 231 at two places can restrain the strength of the beam member 230 near the center position from deteriorating, and can restrain the beam member 230 from bending and breaking at the center position.

As above, the inkjet recording apparatus 1 of the first embodiment includes the plurality of head modules 21 each having nozzle arrays in each of which two or more nozzles N each of which ejects ink are one-dimensionally arranged, the support member 22 to which the plurality of head modules 21 are attached at positions different from one another in the X-direction (predetermined arrangement direction) in the state where the nozzle arrays are oriented in the X-direction, and the support member deforming part 23 which deforms the support member 22 in the direction in which a deflection of the support member 22 is reduced.

According to such a configuration, since the deflection of the support member 22 can be reduced by deforming the support member 22 with the support member deforming part 23, the positions of the plurality of head modules 21 can be adjusted such that positional displacements of the plurality of head modules 21 caused by the deflection of the support member 22 are reduced. Moreover, by reducing the deflection of the support member 22, the positions of the plurality of head modules 21 attached to the support member 22 can be collectively adjusted. Therefore, as compared with a conventional technique of individually adjusting the positions of the head modules 21, the positions of the plurality of head modules 21 can be simply adjusted in a less time-consuming way.

Moreover, each of the plurality of head modules 21 is attached to the support member 22 in the state where the nozzle opening face 21*a* on which the openings of the nozzles N are formed is exposed from the lower face S1 of the support member 22, and the support member deforming part 23 is provided on the opposite side to the lower face S1 side of the support member 22. According to this, the positions of the head modules 21 can be easily adjusted even in the state where the support member 22 faces the conveying belt 12. Moreover, a failure that the nozzle opening faces 21*a* of the head modules 21 are stained and damaged caused by adjustment work of the positions of the head modules 21 can be made to scarcely arise. Moreover, the deflection can be adjusted at a position where a user can easily reach them.

Moreover, the support member deforming part 23 deforms the support member 22 in the direction in which the deflection caused by the lower face S1 of the support member 22 being displaced from the flat plane is reduced. According to this, the distances between the nozzle opening faces 21*a* of the plurality of head modules 21 and the conveying surface of the conveying belt 12 (accordingly, the recording medium M on the conveying surface) can be restrained from varying due to the deflection of the support member 22. Therefore, image quality can be restrained from deteriorating due to the impact position of ejected ink being displaced from a desired position, the ink ejected from the nozzles N of each head module 21.

Moreover, the support member deforming part 23 deforms the support member 22 in the direction in which the deflection of the support member 22 due to the weight of the plurality of head modules 21 is reduced. According to this, the lower face S1 of the support member 22 can be maintained in a desired shape to restrain the positional displacements of the head modules 21 even when strength of the support member 22 is not sufficient against the weight of the head modules 21.

Moreover, the support member deforming part 23 has the beam member 230 extending across a range overlapping with at least part of an extending range of the support member 22 in the X-direction, and provided so as to be able to fix its distance from the support member 22 at a plurality of positions different in the X-direction, and the adjusting connection member 232 that adjusts the distance between the beam member 230 and the support member 22 at at least one of the plurality of positions such that the support member 22 is deformed in the direction in which the deflection of the support member 22 is reduced. According to this, the deflection of the support member 22 can be reduced by a simple method of adjusting the distance between the beam member 230 and the support member 22 to collectively adjust the positions of the plurality of the head modules 21.

Moreover, the beam member 230 extends across a range including ranges where the nozzles N are provided in the plurality of head modules 21 in the X-direction. According to this, the deflection in at least a range, of the support member 22, where the positions of the nozzles N can be affected can be effectively reduced to restrain the positional displacement of the nozzles N.

Moreover, the adjusting connection member 232 is provided such that the distance between the beam member 230 and the support member 22 can be adjusted within a range where the deformation of the beam member 230 is elastic deformation. According to this, an occurrence of a failure of plastic deformation of the beam member 230 in adjusting the deflection of the support member 22 can be restrained.

Moreover, the support member 22 includes the support plate 221 having the lower face S1, and each adjusting connection member 232 is provided capable of adjusting the distance between the beam member 230 and the support plate 221 such that the support plate 221 is deformed in the direction in which the deflection of the support plate 221 is reduced. According to this, the positions of the plurality of head modules 21 can be collectively adjusted by reducing the deflection of the support plate 221.

Moreover, the beam member 230 is provided so as to be able to fix its distance from the upper face S2 on the opposite side to the lower face S1 of the support plate 221 at the plurality of positions, and the adjusting connection member 232 is provided capable of adjusting the distance between the beam member 230 and the upper face S2 at at least one of the plurality of positions such that the support plate 221 is deformed in the direction in which the deflection caused by the lower face S1 being displaced from the flat plane is reduced. The distances between the nozzle opening faces 21*a* of the plurality of head modules 21 and the conveying surface of the conveying belt 12 can be restrained from varying caused by the deflection of the support member 22. Therefore, image quality can be restrained from deteriorating due to the impact position of ejected ink being displaced from a desired position, the ink ejected from the nozzles N of each head module 21.

Moreover, the support member 22 further has the plate-like reinforcement member 222 which is fixed to bond onto the upper face S2 on the opposite side to the lower face S1 of the support plate 221 and extends in the direction perpendicular to the upper face S2. Providing such a reinforcement member 222 enables the deflection of the support plate 221 to scarcely arise.

Moreover, the beam member 230 is attached to the reinforcement member 222. According to this, the deflection of the support plate 221 can be reduced via the reinforcement member 222. Moreover, the positions of the head modules 21 can be easily adjusted even in the case where the support member 22 faces the conveying belt 12. Moreover, a failure that the nozzle opening faces 21*a* of the head modules 21 are stained and damaged caused by adjustment work of the positions of the head modules 21, can be made to scarcely arise. Moreover, the deflection can be adjusted at a position where a user can easily reach them.

Moreover, the beam member 230 is attached onto the opposite side to the side on which the reinforcement member 222 is fixed to the support plate 221. According to this, the distances between the nozzle opening faces 21*a* of the plurality of head modules 21 and the conveying surface of the conveying belt 12 can be restrained from varying caused by the deflection of the support member 22. Moreover, since the deflection is adjusted with the adjusting connection members 232 at the furthest positions, on the support member 22, from the nozzle opening faces 21*a*, the deflection can be adjusted at a position where a user can easily reach them while reducing the influence on the nozzles N.

Moreover, the inkjet recording apparatus 1 of the present embodiment includes the conveyor 10 which conveys the recording medium M, and the head modules 21 are attached to the support member 22 in a direction in which the arrangement direction of the nozzle arrays intersects the conveying direction of the recording medium M by the conveyor 10 and in a positional relation where the plurality of nozzles N included in the plurality of head modules 21 are provided across a recording width of an image on the recording medium M in the width direction perpendicular to the conveying direction. According to this, an image can be recorded in a single-pass system. While in the single-pass system, the length of a line head composed of the plurality of head modules 21 tends to be large, which tends to cause a deflection of the support member 22, by reducing the deflection of the support member 22 with the support member deforming part 23, the positions of the plurality of head modules 21 can be simply adjusted.

Second Embodiment

Next, a second embodiment is described. The second embodiment is different from the first embodiment in the shape and the attachment position of the beam member 230. Its differences from the first embodiment are hereafter described.

Figure 12:
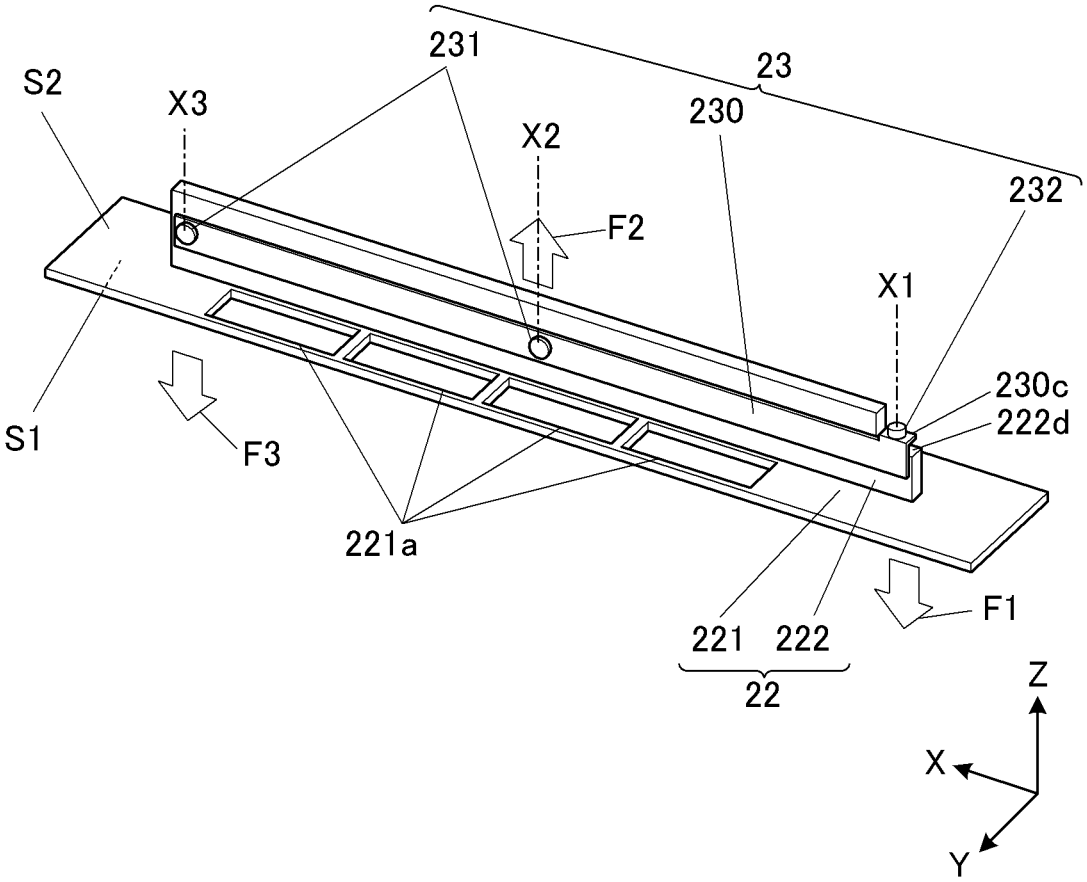
FIG. 12 is a perspective view showing a configuration of the support member and the support member deforming part according to a second embodiment.

FIG. 12 is a perspective view showing a configuration of the support member 22 and the support member deforming part 23 according to the second embodiment. The beam member 230 of the present embodiment is attached onto a lateral face, of the reinforcement member 222, that is oriented in the +Y-direction. More in detail, the beam member 230 is fixed onto the lateral face of the reinforcement member 222 at two places of the center position thereof in the X-direction and the end part thereof on the +X-direction side with the fixing connection members 231. Moreover, to the end part of the beam member 230 on the −X-direction side, an elongated part 230*c* which comes around onto the upper face (face oriented in the +Z-direction) of a notch part 222*d* provided in the reinforcement member 222, is attached. The beam member 230 is connected to the reinforcement member 222 with the adjusting connection member 232 in the state where the distance between this elongated part 230*c* and the notch part 222*d* of the reinforcement member 222 in the Z-direction can be adjusted. Namely, there can be employed a configuration in which the distance between the reinforcement member 222 and the beam member 230 in the Z-direction is fixed at the center position in the X-direction (hereinafter expressed as position X2) and the end part position on the +X-direction side (hereinafter expressed as position X3), and can be adjusted at the end part position on the −X-direction (hereinafter expressed as position X1).

Moreover, attachment holes (not shown in the figure) provided at the position X2 and the position X3 in the beam member 230, in order to cause the two fixing connection members 231 to pass therethrough, are long holes extending in the X-direction, and an attachment hole provided at the position X1 in the beam member 230, in order to cause the adjusting connection member 232 to pass therethrough, is a circular hole. According to this, when the support member 22 and the beam member 230 are deformed with different deformation amounts caused by different coefficients of thermal expansion, the support member 22 and the beam member 230 can be restrained from being distorted upon reception of pieces of force from the three connection positions. Notably, any one of the three attachment holes provided at the positions X1, X2 and X3 may be circular, the other two being long holes.

By rotating the adjusting connection member 232 in this configuration to increase the distance between the reinforcement member 222 and the beam member 230 at the position X1 in the Z-direction, a deflection of the support member 22 convex downward can be reduced similarly to the first embodiment. Namely, when the distance between the reinforcement member 222 and the beam member 230 at the position X1 in the Z-direction is increased, the support member 22 receives resistance F1 oriented in the −Z-direction from the beam member 230 at the position X1, receives resistance F2 oriented in the +Z-direction from the beam member 230 at the position X2, receives resistance F3 oriented in the −Z-direction from the beam member 230 at the position X3, and hence, is deformed such that its deflection convex downward is reduced. Here, the measurements of the resistances F1 to F3 satisfy a relation of F1=F3 and F1+F3=F2.

Accordingly, also with the configuration of the present embodiment, the positions of the plurality of head modules 21 in the Z-direction can be more simply adjusted.

Notably, while in FIG. 12, the beam member 230 is provided only on the lateral face of the reinforcement member 222 on the +Y-direction side, the beam member 230 may be provided on both lateral faces of the reinforcement member 222.

As above, in the inkjet recording apparatus 1 of the second embodiment, the beam member 230 is attached onto the perpendicular face, of the reinforcement member 222, to the upper face S2. According to this, the beam member 230 can be attached so as to attain a sufficient effect of reducing the deflection of the support member 22 even in a configuration in which it is difficult to provide the beam member 230 on the upper face of the reinforcement member 222 in a case where the reinforcement member 222 is thin or the similar case.

Third Embodiment

Next, a third embodiment is described. The third embodiment is different from the first embodiment in a positional relation between the support member 22 and the beam member 230 and a connection mode of these. Its differences from the first embodiment are hereafter described.

Figure 13A:
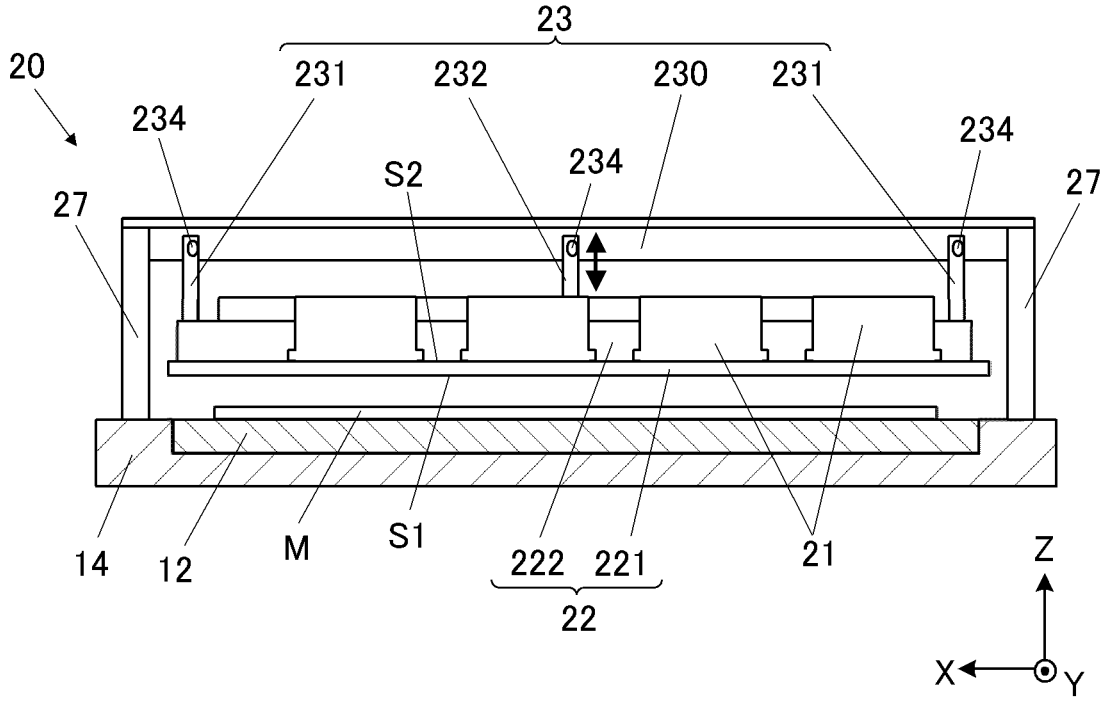
FIGS. 13A and 13B are views showing a configuration of the head unit according to a third embodiment.
Figure 13B:
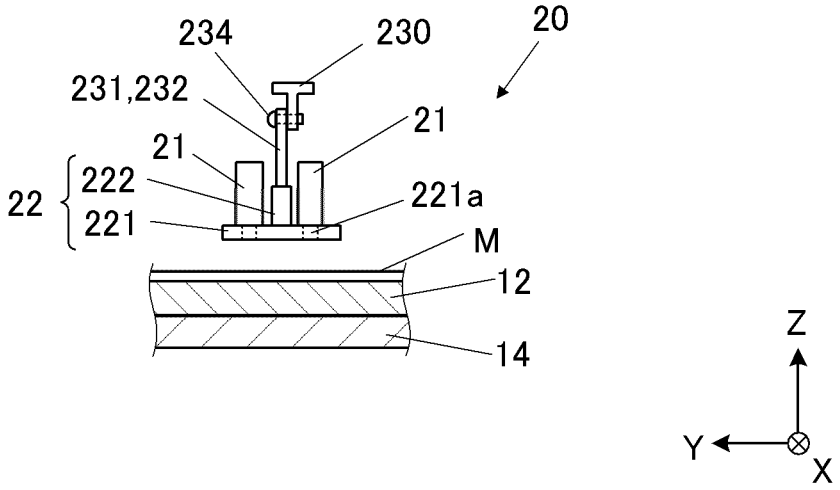

FIGS. 13A and 13B are views showing a configuration of the head unit 20 according to the third embodiment. FIG. 13A is a view of the internal configuration of the head unit 20 as seen from the +Y-direction, and FIG. 13B is a view of the internal configuration of the head unit 20 as seen from the −X-direction. Illustration of the casing 25 is omitted from FIGS. 13A and 13B.

In the head unit 20 of the present embodiment, the beam member 230 is provided in the state of being spaced from the support member 22. The beam member 230 is arranged so as to be parallel to the X-direction in the state where both ends of the same in the X-direction are supported on props 27. The props 27 are fixed to a belt support member 14 which supports the inner circumferential surface of the conveying belt 12 of the conveyor 10. Moreover, the props 27 are configured such that their lengths in the Z-direction can be adjusted. The beam member 230 and the props 27 may be integrally formed. The fixing connection members 231 are attached to the beam member 230 near both ends of the beam member 230 in the X-direction with fastening members 234, and the adjusting connection member 232 is attached to the beam member 230 at the center position of the beam member 230 in the X-direction with a fastening member 234. These fixing connection members 231 and the adjusting connection member 232 are fixed onto the upper face of the reinforcement member 222 at their end parts on the opposite side to the beam member 230 side. Namely, the support member 22 is connected to the beam member 230 in the state of being hung from the beam member 230 with the three connection members (the two fixing connection members 231 and the one adjusting connection member 232). Notably, the relative position of the support member 22 to the casing 25 may be adjusted and fixed in order to prevent the support member 22 from swinging.

Each fixing connection member 231 is a rod-like member the length of which in the Z-direction is fixed. Accordingly, the distances between the beam member 230 and the reinforcement member 222 in the Z-direction are fixed at the positions where the fixing connection members 231 are provided.

Figure 14A:
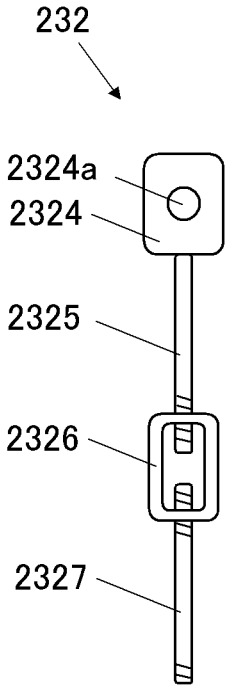
FIGS. 14A and 14B are views showing a configuration of the adjusting connection member according to a third embodiment.
Figure 14B:
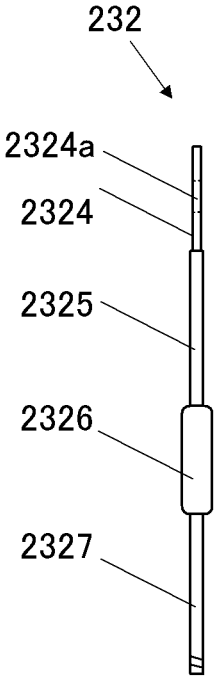

FIGS. 14A and 14B are views showing a configuration of the adjusting connection member 232 according to the third embodiment. FIG. 14A is an elevational view of the adjusting connection member 232, and FIG. 14B is a lateral view of the adjusting connection member 232.

The adjusting connection member 232 has a head part 2324 in which an attachment hole 2324*a* for causing the fastening member 234 to pass through, a rod-like first base part 2325 connected to the head part 2324, a rod-like second base part 2327, and a connector 2326 connecting the first base part 2325 and the second base part 2327 together. Screw threads are provided near the lower end of the first base part 2325 and the upper end of the second base part 2327, and by fitting them into screw holes provided in the connector 2326, the first base part 2325, the connector 2326 and the second base part 2327 are connected together. Moreover, a screw thread is provided near the lower end of the second base part 2327 so as to be fitted into a screw hole provided in the reinforcement member 222, and accordingly, the second base part 2327 can be fixed to the reinforcement member 222.

By rotating the connector 2326 in the state where the head part 2324 is fixed to the beam member 230 and the second base part 2327 is fixed to the reinforcement member 222, the distance between the first base part 2325 and the second base part 2327 can be changed, and thereby, the whole length of the adjusting connection member 232 can be adjusted.

When the support member 22 bends to be convex downward, the support member 22 can be deformed such that a deflection of the support member 22 is reduced by rotating the connector 2326 in a direction in which the length of the adjusting connection member 232 is reduced to shorten the distance between the reinforcement member 222 and the beam member 230 at the center position in the X-direction.

After the deflection of the support member 22 is relieved as above, the lengths of the props 27 are adjusted, and thereby, the distances between the nozzle opening faces 21*a* of the head modules 21 and the conveying surface of the conveying belt 12 can be made uniform at a predetermined value.

Notably, in place of the configuration in which both ends of the beam member 230 are connected to the reinforcement member 222 with the fixing connection members 231, they may be connected also at both ends using the adjusting connection members 232 the lengths of which in the Z-direction can be adjusted. In this case, by adjusting each of the lengths of the adjusting connection members 232, the distances between the nozzle opening faces 21*a* of the head modules 21 and the conveying surface of the conveying belt 12 can be adjusted as well while reducing the deflection of the support member 22.

Moreover, the fixing connection members 231 and the adjusting connection member 232 do not have to have the aforementioned structures but may be screws or the like, for example, as long as they have strength against the weight of the support member 22 and the head modules 21.

Moreover, not limited to the configuration in which the total number of the fixing connection members 231 and the adjusting connection member 232 is three, the number thereof may be four or more. For example, with the fixing connection members 231 provided at both ends in the X-direction, three adjusting connection members 232 may be provided therebetween, and thereby the distance between the reinforcement member 222 and the beam member 230 is adjusted with the three adjusting connection members 232. The more the number of adjusting connection members 232 is, the finer the support member 22 can be deformed such that the deflection of the support member 22 is reduced.

As above, in the inkjet recording apparatus 1 of the third embodiment, the support member 22 is connected to the beam member 230 in the state of being hung from the beam member 230 with three or more connection members, and at least one of the three or more connection members is the adjusting connection member 232. Also with such a configuration, the positions of the plurality of head modules 21 can be simply adjusted in a less time-consuming way. Moreover, the deflection can be adjusted at a position where a user can easily reach them. Moreover, by making the connection member adjustable in its length, the distances between the nozzle opening faces 21*a* of the head modules 21 and the conveying surface of the conveying belt 12 can be adjusted as well while the deflection of the support member 22 is reduced.

Fourth Embodiment

Next, a fourth embodiment is described. The fourth embodiment is different from the first embodiment in the configuration of the conveyor 10, the direction of the deflection of the support member 22, and the adjustment method thereof. Its differences from the first embodiment are hereafter described.

Figure 15:
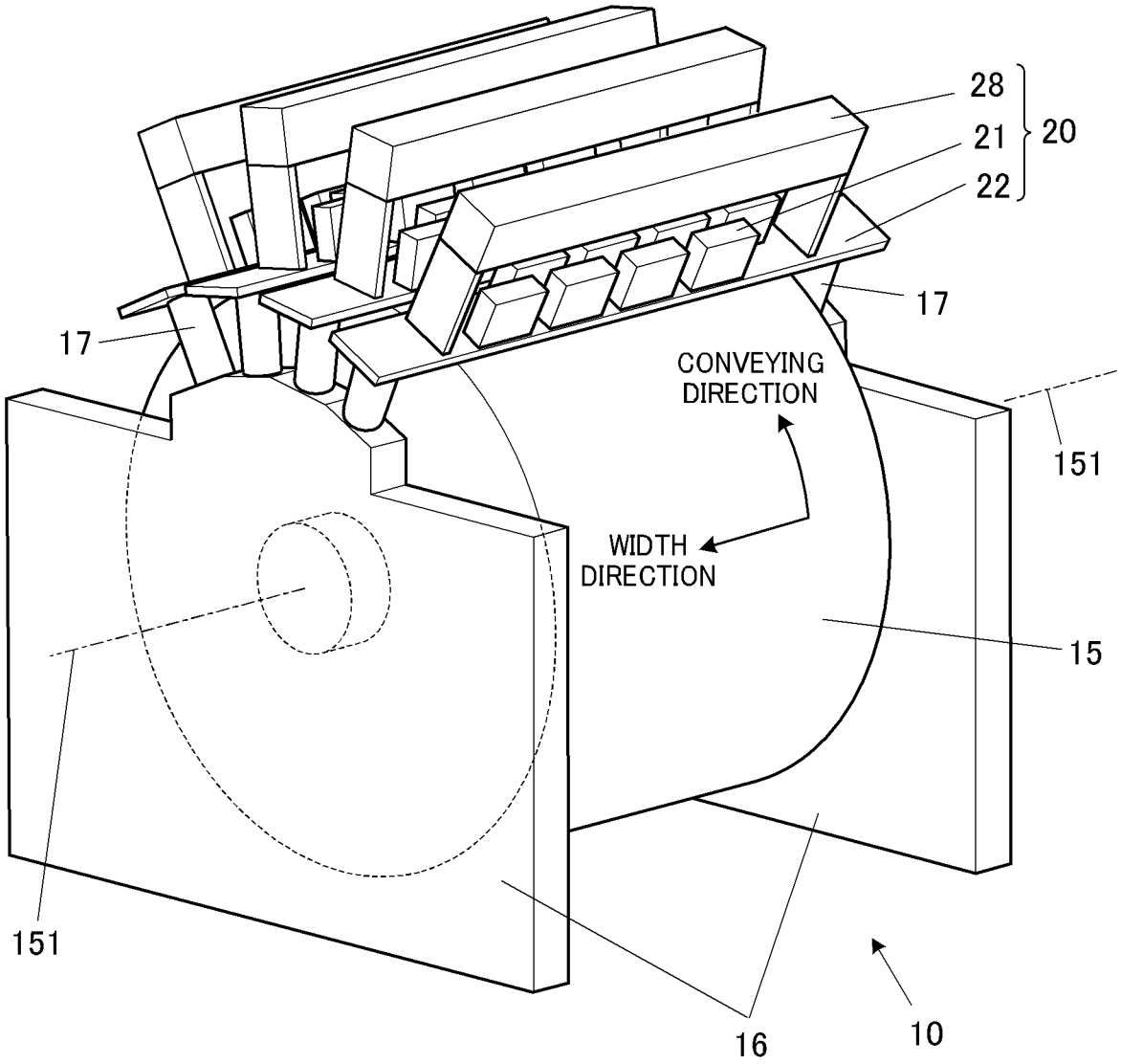
FIG. 15 is a perspective view showing a conveyor and head units according to a fourth embodiment.

FIG. 15 is a perspective view showing the conveyor 10 and the head units 20 according to the fourth embodiment.

The conveyor 10 of the present embodiment has a cylinder-shaped conveying drum 15, bases 16 which support the rotational axis of the conveying drum 15, head unit support members 17 which are fixed to the bases 16 and support the head units 20, and the like. The conveying drum 15 is rotated around a rotational axis 151 in the state of holding the recording medium M placed on its outer circumferential surface (conveying surface), and thereby, conveys the recording medium M on the outer circumferential surface in a circulating direction (conveying direction) of the outer circumferential surface. The conveying drum 15 includes not-shown claw parts and suction part for holding the recording medium M on the outer circumferential surface. The recording medium M is held on the outer circumferential surface in the state where its end parts are pressed by the claw parts and it is caused to adhere onto the outer circumferential surface with the suction part. The conveyor 10 has a not-shown conveying drum motor for rotating the conveying drum 15, and the conveying drum 15 is rotated by an angle proportional to the amount of rotation of the conveying drum motor.

Each head unit 20 is fixed at end parts, of the lower face S1 of the support plate 221, which are outward of the region facing the outer circumferential surface of the conveying drum 15 by the head unit support members 17. The head unit support members 17 are adjustable in length, and thereby, can adjust the distances between the nozzle opening faces 21*a* of the head modules 21 and the outer circumferential surface of the conveying drum 15. Moreover, the head unit 20 has an upper casing 28 which houses ink tanks and the like above the head modules 21.

Each head unit 20 is fixed after adjusting an angle such that the nozzle opening faces 21*a* of the head modules 21 face the outer circumferential surface of the conveying drum 15 in the state of being substantially parallel to the outer circumferential surface. Accordingly, the nozzle opening faces 21*a* and the lower face S1 of the support plate 221 are brought into a state of being inclined relative to the horizontal plane depending on an inclination angle at the position, on the outer circumferential surface of the conveying drum 15, where these nozzle opening faces 21*a* face the outer circumferential surface. As a result, the support member 22 of each head unit 20 is arranged in a direction in which the normal line to the lower face S1 of the support plate 221 is inclined relative to the vertical direction.

The head unit 20 being inclined and fixed is to cause the center of gravity of the head unit 20 to be displaced in the horizontal direction relative to the fixation position thereof with the head unit support members 17. As a result, there arises a momentum, due to the gravity, which allows the head unit 20 to rotate with the fixation position as the rotational center. This results in exerting force in the direction parallel to the lower face S1 of the support plate 221 onto the support member 22 as well, and hence, there can arise a deflection in the direction parallel to the lower face S1. Particularly with the configuration in which the upper casing 28 heavy in weight is provided, the displacement of the center of gravity is significant, which tends to cause a deflection of the support member 22 in the direction parallel to the lower face S1.

Therefore, in the present embodiment, the beam member 230, the fixing connection member 231 and the adjusting connection members 232 are provided such that the support member 22 is deformed in a direction in which the deflection of the support member 22 in the direction parallel to the lower face S1 of the support plate 221 is reduced.

Figure 16A:
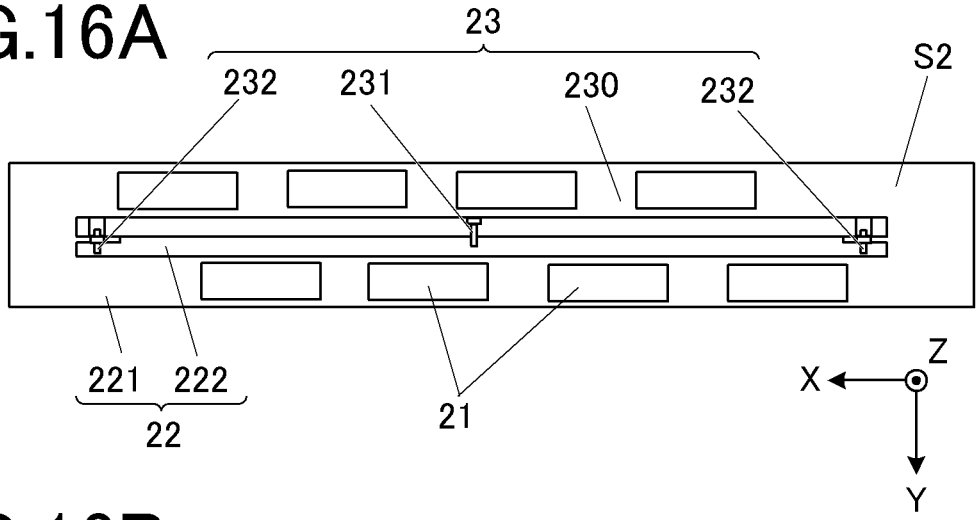
FIGS. 16A to 16C are views for explaining a configuration of the support member deforming part according to the fourth embodiment, and an adjustment method of a deflection of the support member.
Figure 16B:
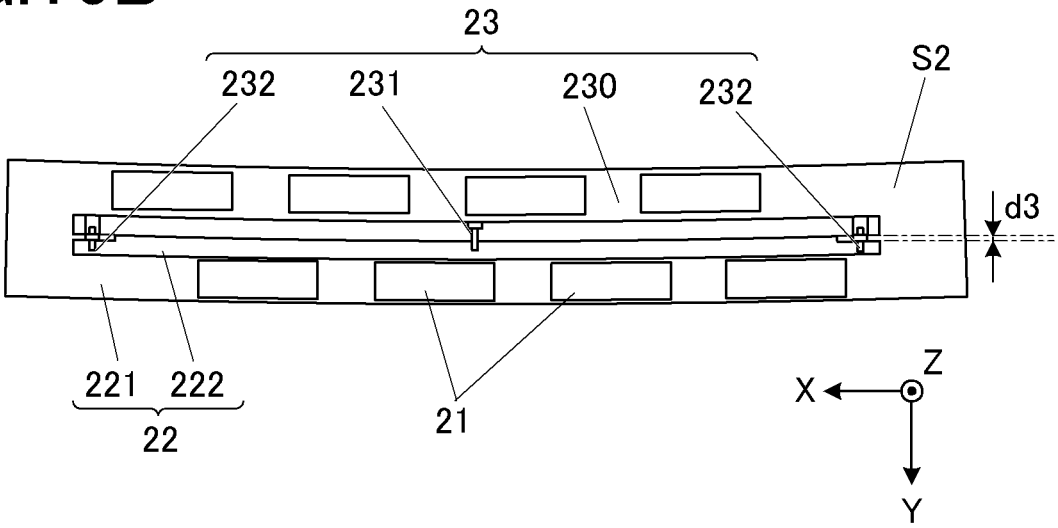
Figure 16C:
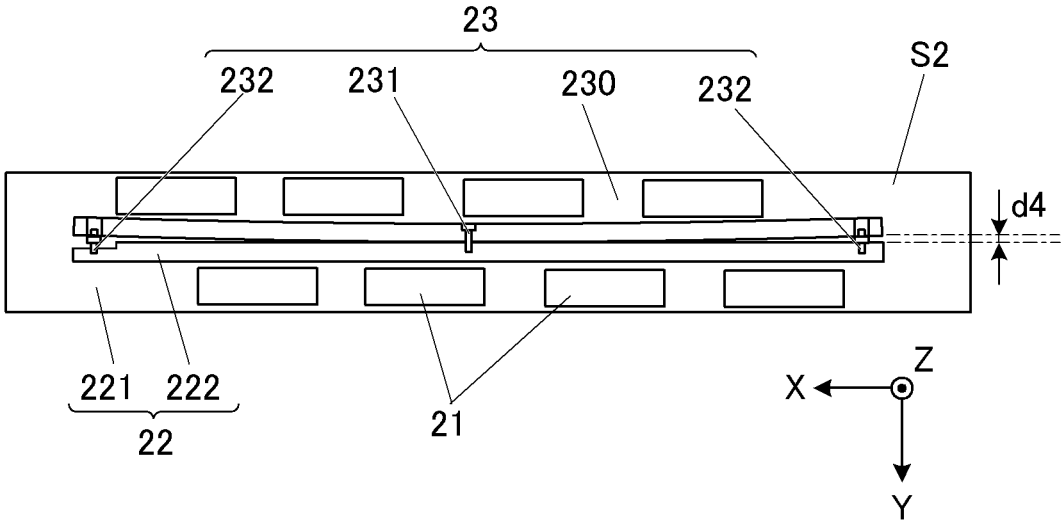

FIGS. 16A to 16C are views for explaining the configuration of the support member deforming part 23 and an adjustment method of the deflection of the support member 22, according to the fourth embodiment. FIGS. 16A to 16C are views of the support member 22 and the support member deforming part 23 as seen from the +Z-direction.

As shown in FIG. 16A, the beam member 230 is attached to the support member 22 of the present embodiment on a lateral face, of the reinforcement member 222, that is oriented in the −Y-direction. The beam member 230 is connected to the reinforcement member 222 from the −Y-direction side at the center position in the X-direction with the fixing connection member 231, and connected to the reinforcement member 222 from the −Y-direction side near both ends in the X-direction with the adjusting connection members 232. The structures of the fixing connection member 231 and the adjusting connection members 232, and the mode in which these are attached to the beam member 230 and the reinforcement member 222 are similar to those for the first embodiment except the attaching direction of these.

FIG. 16B shows a state where the support member 22 and the beam member 230 bend in the direction parallel to the lower face S1 of the support plate 221 due to the weight of the head modules 21 and the upper casing 28. Namely, there arises a deflection such that the center part in the X-direction protrudes to the +Y-direction side on the support member 22 and the beam member 230. In the state of FIG. 16B, a distance between the reinforcement member 222 and the beam member 230 in the Y-direction at an adjustment position where the adjusting connection member 232 is provided is a distance d3.

By rotating two adjusting connection members 232 from the state of FIG. 16B to move the adjusting connection members 232 to the −Y-direction side relative to the reinforcement member 222, the distances between the beam member 230 and the reinforcement member 222 in the Y-direction at the adjustment positions (in other words, the distances between the beam member 230 and fixation positions (specific positions) of the reinforcement member 222 on the support plate 221 in the Y-direction) can be increased (FIG. 16C). In the state of FIG. 16C, the distance between the reinforcement member 222 and the beam member 230 at the adjustment position is a distance d4 (>d3). Meanwhile, the distance between the reinforcement member 222 and the beam member 230 in the Y-direction is fixed at the center position in the X-direction.

By widening the distances at the adjustment positions near the end parts in the X-direction in the state where the distance between the beam member 230 and the support member 22 (accordingly, the specific position on the support plate 221) in the Y-direction is fixed at the center position, the support member 22 can be deformed in the direction in which the deflection of the support member 22 in the direction parallel to the lower face S1 is reduced with the beam member 230 as a support. Further, by appropriately adjusting the amount of rotation of the adjusting connection members 232, that is, the distances between the reinforcement member 222 and the beam member 230 at the adjustment positions, as shown in FIG. 16C, the deflection of the support member 22 can be relieved and the plan shape of the support plate 221 is resumed to be the original rectangular shape.

Notably, while the description above focuses on the support member deforming part 23 that adjusts the deflection parallel to the lower face S1, the support member deforming part 23 that adjusts a deflection of the support plate 221 caused by the lower face S1 being a curved face convex downward (deflection caused by the lower face S1 being displaced from the flat plane), may be provided besides similarly to the first embodiment. With the configuration in the present embodiment, the momentum which allows the head unit 20 to rotate with the fixation position as the rotational center tends to cause the deflection of the support plate 221 to be a combination of the deflection caused by the lower face S1, as a curved face convex downward, being displaced from the flat plane and the deflection parallel to the lower face S1. Hence, a first support member deforming part and a second support member deforming part may be provided respectively for deforming the support member 22 in the direction in which the deflection caused by the lower face S1 being displaced from the flat plane and for deforming the support member 22 in the direction in which the deflection of the support member 22 in the direction parallel to the lower face S1 is reduced, and thereby, the deflection of the support member 22 can be more effectively reduced.

As above, in the inkjet recording apparatus 1 of the fourth embodiment, the support member 22 is arranged in the direction in which the normal line to the lower face S1 is inclined relative to the vertical direction, and the support member deforming part 23 deforms the support member 22 in the direction in which the deflection of the support member 22 in the direction parallel to the lower face S1 is reduced.

Moreover, the support member 22 is arranged in the direction in which the normal line to the lower face S1 is inclined relative to the vertical direction, the beam member 230 is provided so as to be able to fix its distances from the specific positions on the support plate 221 in the Y-direction parallel to the lower face S1 (predetermined adjusting direction) at the plurality of positions, and the adjusting connection member 232 is provided so as to be able to adjust the distance between the beam member 230 and the specific position in the Y-direction at at least one of the plurality of positions such that the support plate 221 is deformed in the direction in which the deflection of the support plate 221 in the direction parallel to the lower face S1 is reduced.

According to such a configuration, the positions of the head modules 21 can be restrained from being displaced in the direction parallel to the lower face S1 caused by the deflection of the support member 22. Therefore, image quality can be restrained from deteriorating due to the impact position of ejected ink being displaced from a desired position, the ink ejected from the nozzles N of each head module 21.

Notably, the present invention is not limited to the aforementioned embodiments and modifications but various alterations thereof are possible.

For example, when the support plate 221 has sufficient strength, the reinforcement member 222 may be eliminated, with the beam member 230 directly attached to the support plate 221.

Moreover, while for the aforementioned embodiments, the beam member 230 has been exemplarily described as extending across the range including the ranges where the nozzles N are provided in the plurality of head modules 21, not limited to this, the beam member 230 only has to extend across at least part of the extending range of the support member 22, in particular, a range where the deflection of the support member 22 arises in the arrangement direction of the nozzle array (X-direction).

Moreover, the positional relation between the beam member 230 and the support member 22 is not limited to the modes described for the aforementioned embodiments.

Moreover, while for the aforementioned embodiments, the head module 21 having two recording heads 211 combined has been exemplarily described as the ink ejector, not intended to limit the ink ejector thereto, the ink ejector only has to have a configuration having at least one nozzle array, and, for example, may be a single recording head 211.

Moreover, while for the aforementioned embodiments, the inkjet recording apparatus 1 in a single-pass system has been exemplarily described, the present invention may be applied to an inkjet recording apparatus which records an image while scanning a head unit.

Some embodiments of the present invention have been described, and the scope of the present invention is not limited to the embodiments mentioned above but contains the scope of the invention disclosed in the claims and its equivalents.

Although embodiments of the present invention have been described and illustrated in detail, the disclosed embodiments are made for purposes of illustration and example only and not limitation. The scope of the present invention should be interpreted by terms of the appended claims

What is claimed is:

1. An inkjet recording apparatus comprising:

a plurality of ink ejectors each having a nozzle array in which two or more nozzles each of which ejects ink are one-dimensionally arranged;

a support member to which the plurality of ink ejectors are attached at positions different from one another in a predetermined arrangement direction in a state where the nozzle array is oriented in the arrangement direction; and a support member deformer that deforms the support member in a direction in which a deflection of the support member is reduced, wherein the support member deformer has a beam member extending across a range overlapping with at least part of an extending range of the support member in the arrangement direction, and provided so as to be able to fix its distance from the support member at a plurality of positions different in the arrangement direction, and an adjustment member that adjusts the distance between the beam member and the support member at at least one of the plurality of positions such that the support member is deformed in the direction in which the deflection of the support member is reduced.

2. The inkjet recording apparatus according to claim 1, wherein each of the plurality of ink ejectors is attached to the support member in a state where a nozzle opening face on which openings of the nozzles are formed is exposed from a predetermined first face of the support member, and the support member deformer is provided on an opposite side to the first face side of the support member.

3. The inkjet recording apparatus according to claim 1, wherein each of the plurality of ink ejectors is attached to the support member in a state where a nozzle opening face on which openings of the nozzles are formed is exposed from a predetermined first face of the support member, and the support member deformer deforms the support member in the direction in which the deflection caused by the first face of the support member being displaced from a flat plane is reduced.

4. The inkjet recording apparatus according to claim 1, wherein each of the plurality of ink ejectors is attached to the support member in a state where a nozzle opening face on which openings of the nozzles are formed is exposed from a predetermined first face of the support member, the support member is arranged in a direction in which a normal line to the first face is inclined relative to a vertical direction, and the support member deformer deforms the support member in a direction in which the deflection of the support member in a parallel direction to the first face is reduced.

5. The inkjet recording apparatus according to claim 1, wherein the support member deformer deforms the support member in the direction in which the deflection of the support member due to a weight of the plurality of ink ejectors is reduced.

6. The inkjet recording apparatus according to claim 1, wherein the beam member extends across a range including ranges where the nozzles are provided in the plurality of ink ejectors in the arrangement direction.

7. The inkjet recording apparatus according to claim 1, wherein the adjustment member is provided capable of adjusting the distance between the beam member and the support member within a range where deformation of the beam member is elastic deformation.

8. The inkjet recording apparatus according to claim 1, wherein each of the plurality of ink ejectors is attached to the support member in a state where a nozzle opening face on which openings of the nozzles are formed is exposed from a predetermined first face of the support member, the support member includes a support plate having the first face, and the adjustment member is provided capable of adjusting a distance between the beam member and the support plate such that the support plate is deformed in a direction in which a deflection of the support plate is reduced.

9. The inkjet recording apparatus according to claim 8, wherein the beam member is provided so as to be able to fix its distance from a second face on an opposite side to the first face of the support plate at the plurality of positions, and the adjustment member is provided capable of adjusting the distance between the beam member and the second face at at least one of the plurality of positions such that the support plate is deformed in a direction in which the deflection caused by the first face being displaced from a flat plane is reduced.

10. The inkjet recording apparatus according to claim 9, wherein the support member further has a plate-like reinforcement member fixed to bond onto the second face on an opposite side to the first face of the support plate and extending in a direction perpendicular to the second face, and the beam member is attached onto an opposite side to a side on which the reinforcement member is fixed to the support plate.

11. The inkjet recording apparatus according to claim 8, wherein the support member is arranged in a direction in which a normal line to the first face is inclined relative to a vertical direction, the beam member is provided so as to be able to fix its distance from a specific position of the support plate in a predetermined adjustment direction parallel to the first face at the plurality of positions, and the adjustment member is provided capable of adjusting the distance between the beam member and the specific position in the adjustment direction at at least one of the plurality of positions such that the support plate is deformed in a direction in which the deflection of the support plate in the direction parallel to the first face is reduced.

12. The inkjet recording apparatus according to claim 11, wherein the support member further has a plate-like reinforcement member fixed to bond onto a second face on an opposite side to the first face of the support plate and extending in a direction perpendicular to the second face, and the beam member is attached onto a face, of the reinforcement member, perpendicular to the second face.

13. The inkjet recording apparatus according to claim 8, wherein the support member further has a plate-like reinforcement member fixed to bond onto a second face on an opposite side to the first face of the support plate and extending in a direction perpendicular to the second face.

14. The inkjet recording apparatus according to claim 13, wherein the beam member is attached to the reinforcement member.

15. The inkjet recording apparatus according to claim 1, wherein the support member is connected to the beam member in a state of being hung from the beam member with three or more connection members, and at least one of the three or more connection members is the adjustment member.

16. The inkjet recording apparatus according to claim 1, comprising a conveyor that conveys a recording medium, wherein the plurality of ink ejectors are attached to the support member in a direction in which the arrangement direction intersects a conveying direction of the recording medium by the conveyor and in a positional relation where the plurality of nozzles included in the plurality of ink ejectors are provided across a recording width of an image on the recording medium in a width direction perpendicular to the conveying direction.

* * * * *